United States Patent [19]

Chamberlain

[11] Patent Number: 5,046,207

[45] Date of Patent: Sep. 10, 1991

[54] ADJUSTABLE BED SHEET

[75] Inventor: W. James Chamberlain, Elkhart, Ind.

[73] Assignee: Coachmen Industries, Inc., Elkhart, Ind.

[21] Appl. No.: 631,979

[22] Filed: Dec. 21, 1990

[51] Int. Cl.[5] ..... A47G 9/02

[52] U.S. Cl. ..... 5/496; 5/497

[58] Field of Search ..... 5/486, 496, 497, 499; 297/219

[56] References Cited

U.S. PATENT DOCUMENTS 1,996,575 4/1935 Fry et al. ..... 297/219

3,020,566 2/1962 Anderson et al. ..... 5/496 X 3,857,124 12/1974 Hadley ..... 5/496

4,727,608 3/1988 Joyce ..... 5/496 X 4,970,744 11/1990 Davis ..... 5/496

FOREIGN PATENT DOCUMENTS 2216409 10/1989 United Kingdom ..... 5/497

*Primary Examiner*—Michael F. Trettel

*Attorney, Agent, or Firm*—Thomas J. Dodd

[57] ABSTRACT

A bed sheet which includes an elastic band sewn to the periphery of the sheet. A drawstring fitted inside the band allows the sheet to be drawn tight about mattresses of varying sizes and shapes.

2 Claims, 3 Drawing Sheets

ADJUSTABLE BED SHEET

SUMMARY OF THE INVENTION

This invention relates to bed sheets and will have application to a fitted sheet which is adjustable to snugly fit many sizes and shapes of mattresses Bedding, particularly in the RV and manufactured housing industry, comes in many different sizes and shapes. Since room space is often engineered without regard to the bedding, the mattress is often of an irregular shape and size to allow it to be fitted into the available space.

Fitted sheets for such mattresses had to be custom made or they would not fit properly over such beds. As a result, the RV owner often had to buy special sheets direct from the RV manufacturer and was thus limited to certain colors and pricing, as well as the time involved to special order.

The fitted bed sheet of this invention includes a drawstring enclosed within the elastic border of the sheet. After placing the sheet over a bed, the drawstring is pulled taut to allow the sheet corners to snugly fit against the mattress corners and create a tight, aesthetically pleasant-looking bed no matter what the size or shape of the mattress.

Accordingly, it is an object of this invention to provide for a bed sheet which fits snugly against many sizes of mattresses.

Another object is to provide for an adjustable fitted bed sheet which is efficient and economical.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 3:
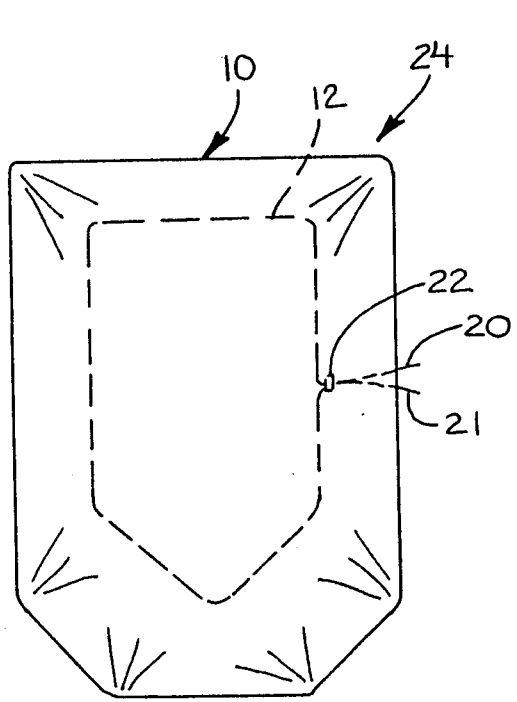
FIG. 3 is a top plan view of the sheet in use on an irregular sized and shaped bed.

The preferred embodiment herein described is not intended to be exhaustive or to limit the invention to the precise form disclosed. It is chosen and described to explain the principles of the invention and its application and practical use to enable others skilled in the art to utilize its teachings.

FIGS. 1-6 illustrate a bed sheet 10 constructed according to the teachings of this invention. Sheet 10 is formed of conventional fabric material and includes a peripheral elastic band 12 sewn onto the sheet to allow snug fitting at the corners of a bed. It should be noted that sheet 10 shown in the drawings is adaptable to fit all sizes of beds between twin size 14 (FIG. 2) and queen size 16 (FIG. 1) the overall dimensions of the sheet are offered only as examples of the concept and are not limiting as to the construction of the sheet.

Drawstring 18 is fitted within an interior channel defined in elastic band 12. Since band 12 is substantially continuous about the outer periphery of sheet 10, drawstring 18 can function to tighten or cinch the sheet tight about the various bed sizes. Drawstring 18 terminates in exposed ends 20 and 21 which extend through a locking device 22, typically a spring loaded catch of conventional design. Locking device 22 can be drawn close against band 12 after cinching to prevent slippage and bunching of sheet 10 on the bed.

Figure 2:
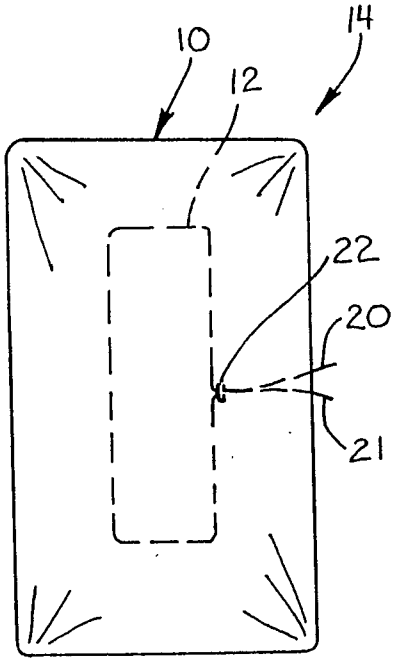
FIG. 2 is a top plan view of the sheet in use on a twin bed.
Figure 1:
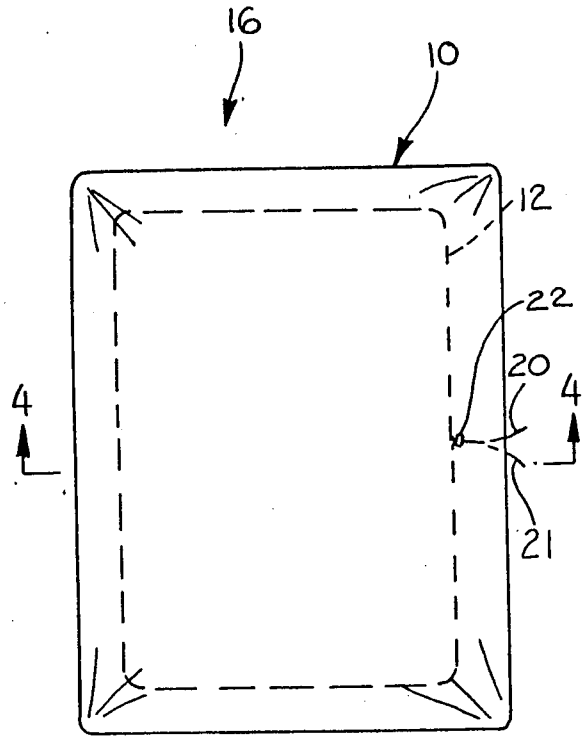
FIG. 1 is a top plan view of the bed sheet of this invention in use on a regular size double bed.
Figure 4:
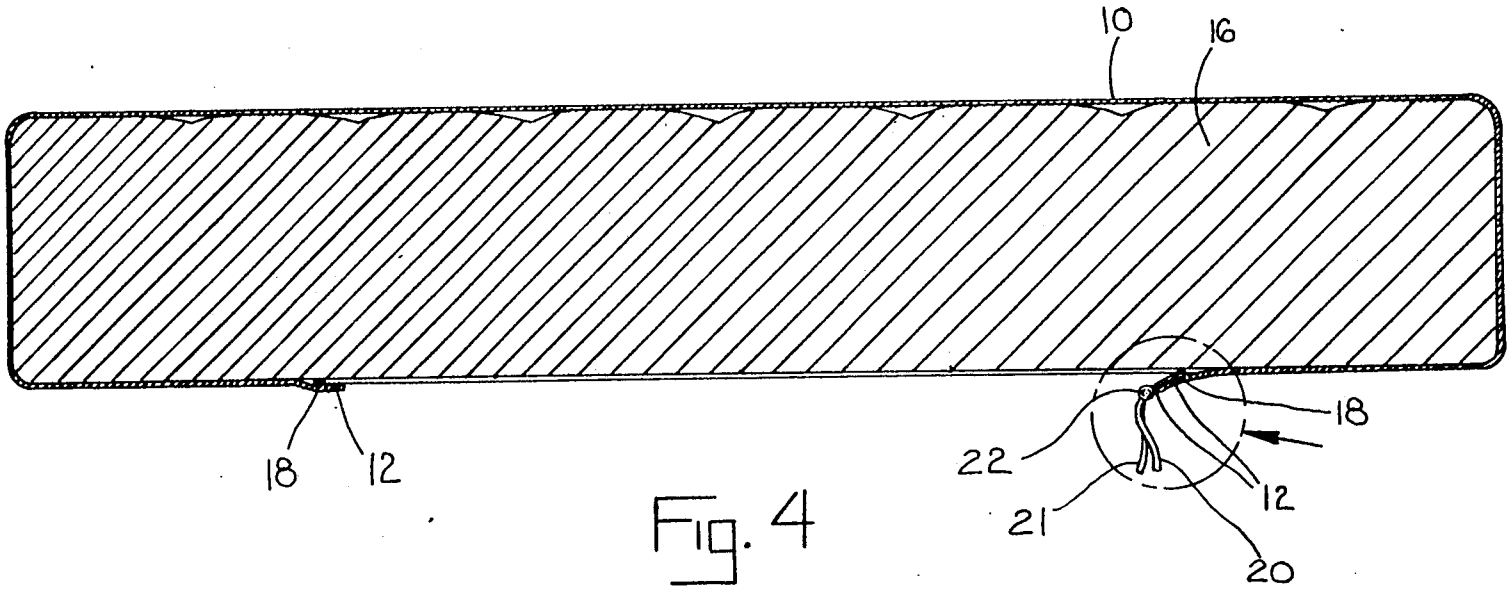
FIG. 4 is a sectional view of a bed showing the drawstring attachment taken along line 4—4 of FIG. 1.
Figure 5:
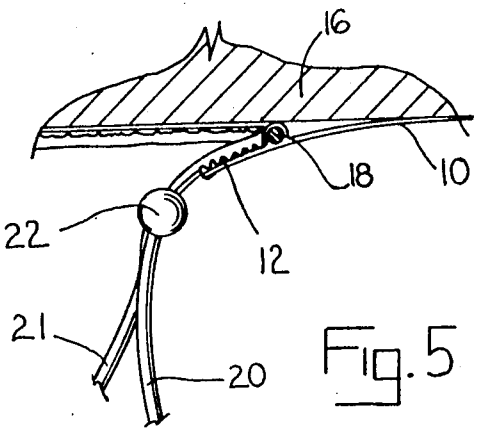
FIG. 5 is a detail view of the drawstring seen within circle 5 of FIG. 4.
Figure 6:
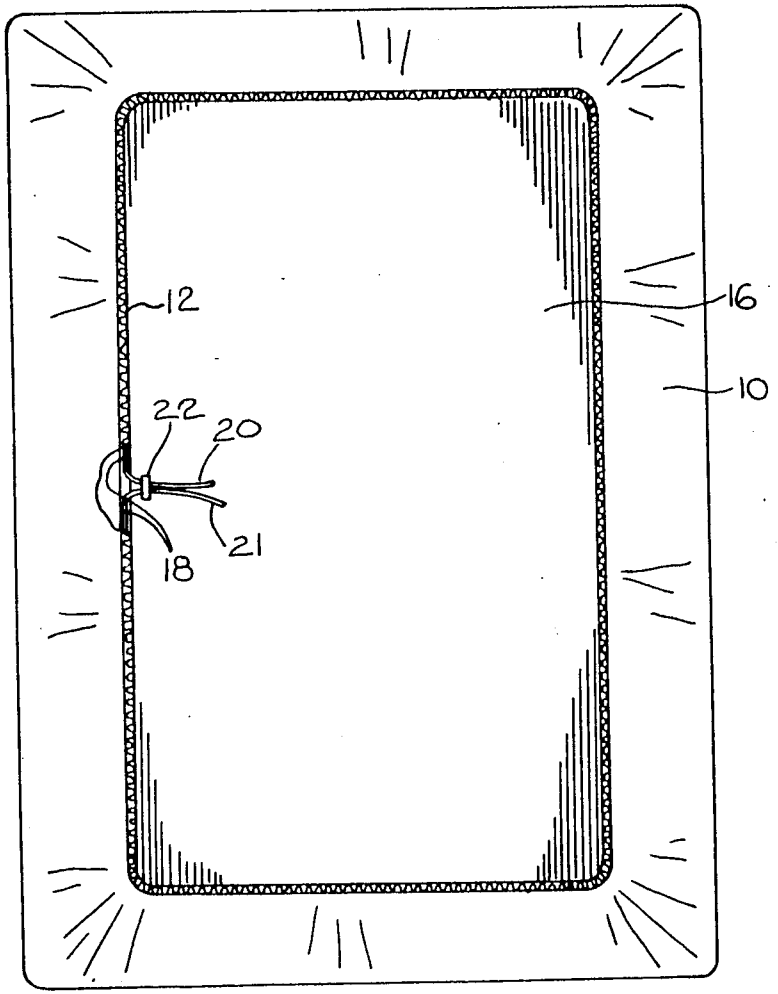
FIG. 6 is a bottom plan view of the bed sheet in use.

FIGS. 1-3 illustrate sheet 10 in use on various sizes of beds, which is a distinct advantage over conventional fitted sheets. FIG. 1 illustrates sheet 10 in use on a typical double or queen size bed 16. Sheet 10 is fitted over bed mattress 17 in a conventional fashion and drawstring 18 pulled tight and locked by device 22 to ensure a snug fit.

Similarly, FIG. 2 illustrates sheet 10 of the same dimensions in use on a conventional twin bed 14 by pulling drawstring 18 tighter to ensure a snug fit as shown. As shown in FIG. 3, sheet 10 also can be adjusted to fit snugly over irregularly sized and shaped beds 24 by virtue of drawstring 18 inside peripheral elastic band 12.

It is understood that the above description does not limit the invention to the precise form disclosed, but may be modified within the scope of the following claims.

I claim:

1. In a bed sheet including a sheet of fabric having multiple side edges joined at corners, said sheet having an elastic band attached to the fabric at each corner thereof to snugly secure the sheet to a bed, the improvement wherein said sheet further includes connected to the sheet at the side edges thereof for adjusting the length of the side edges within the sheet may be fitted snugly against mattresses of many different shapes and sizes, said means for adjusting including an elastic band connected to the side edges of the sheet, a drawstring fitted in said elastic band and terminating outside of the band.

2. The bed sheet of claim 1 and means connected to said drawstring for locking the drawstring in a selected position.

* * * * *